US009798255B1

(12) United States Patent
Wang et al.

(10) Patent No.: US 9,798,255 B1
(45) Date of Patent: Oct. 24, 2017

(54) PHASE INVERSED RESIN EMULSIONS

(71) Applicant: Xerox Corporation, Norwalk, CT (US)

(72) Inventors: Yulin Wang, Oakville (CA); Shigang S. Qiu, Toronto (CA); Chieh-Min Cheng, Rochester, NY (US); Kathryne S. Brockman, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/177,706

(22) Filed: Jun. 9, 2016

(51) Int. Cl.
*G03G 9/087* (2006.01)
*G03G 9/08* (2006.01)

(52) U.S. Cl.
CPC ..... *G03G 9/0804* (2013.01)

(58) Field of Classification Search
CPC ... G03G 9/0804; G03G 9/08755; G03G 9/093
See application file for complete search history.

(56) References Cited

U.S. PATENT DOCUMENTS 7,943,687 B2 5/2011 Faucher et al.
8,741,534 B2 6/2014 Ou et al.
9,201,321 B2 12/2015 Qiu et al.
2007/0212633 A1* 9/2007 Yamagami ..... G03G 9/0804 430/137.14
2010/0266949 A1 10/2010 Lai et al.
2011/0027714 A1 2/2011 McDougall et al.

FOREIGN PATENT DOCUMENTS

JP 2014-149509 * 8/2014 ..... G03G 9/08

OTHER PUBLICATIONS

Translation of JP 2014-149509 pulished Aug. 2014/.*

* cited by examiner

*Primary Examiner* — Peter Vajda

(57) ABSTRACT

A process is provided comprising forming a phase inversed resin emulsion comprising a resin, water, and an organic solvent, wherein the process excludes subjecting the phase inversed resin emulsion to an organic solvent removal technique, thereby retaining the organic solvent in the phase inversed resin emulsion. The phase inversed resin emulsion may be formed by dissolving a resin in an organic solvent to form a resin mixture; optionally, adding a neutralizing agent to the resin mixture to neutralize acid groups on the resin; and adding a sufficient amount of water to the resin mixture to emulsify and induce phase inversion in the resin mixture. Also provided are processes for preparing particles and processes for preparing toners utilizing the phase inversed resin emulsions.

18 Claims, No Drawings

PHASE INVERSED RESIN EMULSIONS

TECHNICAL FIELD

The present disclosure relates generally to processes for producing phase inversed resin emulsions. The present disclosure also relates generally to processes for producing toners utilizing the phase inversed resin emulsions. More specifically, the present disclosure provides energy efficient processes for producing organic solvent-containing phase inversed resin emulsions of polyester resins as well as processes for producing toners from such organic solvent-containing phase inversed resin emulsions.

BACKGROUND

Many emulsion aggregation (EA) toners have been prepared utilizing latexes generated from amorphous and crystalline polyester resins. A solvent-based phase inversion emulsification (PIE) process is often used to produce such latexes. In PIE, the polyester resins are first dissolved in one or more organic solvents (e.g., methyl ethyl ketone and isopropanol). The organic solvent(s) then need to be removed via a vacuum distillation, which is expensive and time consuming. For example, in large scale production, it can take about 4 hours (or more) and mild temperatures to produce the polyester latex whereas solvent stripping can take about 3 times longer (or more) under high temperature and high vacuum. However, organic solvents are removed since residual solvents can produce undesired odors and can negatively affect toner formation and toner properties.

More efficient processes for preparing phase inversed resin emulsions which are suitable for the production of high quality toners, e.g., toners exhibiting excellent charging and blocking characteristics, are desirable.

SUMMARY

The present disclosure provides processes for the preparation of phase inversed resin emulsions and processes utilizing the phase inversed resin emulsions.

One aspect is summarized in the following description of a process for preparing a phase inversed resin emulsion, which may be subsequently used in a method for preparing particles. The process for preparing the phase inversed resin emulsion may include several steps. A first step involves dissolving a resin in an organic solvent to form a resin mixture. An optional step involves adding a neutralizing agent to the resin mixture to neutralize acid groups on the resin. A second step involves adding a sufficient amount of water to the resin mixture to emulsify and induce phase inversion in the resin mixture to form a phase inversed resin emulsion comprising the resin, water, and the organic solvent. However, the process excludes subjecting the phase inversed resin emulsion to an organic solvent removal technique, thereby retaining the organic solvent in the phase inversed resin emulsion. The now organic solvent-containing phase inversed resin emulsion may be used in a method for preparing particles, including a method for preparing a toner.

Another aspect is summarized in the following description of a process for preparing particles. A first step involves employing a mixture to form particles wherein the mixture comprises (i) an optional wax, (ii) an optional colorant, and (iii) a phase inversed resin emulsion comprising a resin, water, and an organic solvent. The process for preparing the phase inversed resin emulsion excludes subjecting the phrase inversed resin emulsion to an organic solvent removal technique, thereby retaining the organic solvent in the phase inversed resin emulsion. Otherwise, the phase inversed resin emulsion may be prepared by the process described above, i.e., dissolving a resin in an organic solvent to form a resin mixture; optionally, adding a neutralizing agent to the resin mixture to neutralize acid groups on the resin; and adding a sufficient amount of water to the resin mixture to emulsify and induce phase inversion in the resin mixture to form the phase inversed resin emulsion. A second step of the process for preparing particles involves aggregating the particles to a predetermined size. A third step of the process for preparing particles involves coalescing the particles of the predetermined size.

Yet another aspect is summarized in the following description of a process for preparing a toner. A first step involves forming a mixture comprising (i) an optional wax, (ii) a colorant, and (iii) a phase inversed resin emulsion comprising a resin, water, and an organic solvent. The process for preparing the phase inversed resin emulsion excludes subjecting the phrase inversed resin emulsion to an organic solvent removal technique, thereby retaining the organic solvent in the phase inversed resin emulsion. Otherwise, the phase inversed resin emulsion may be prepared by the process described above, i.e., dissolving a resin in an organic solvent to form a resin mixture; optionally, adding a neutralizing agent to the resin mixture to neutralize acid groups on the resin; and adding a sufficient amount of water to the resin mixture to emulsify and induce phase inversion in the resin mixture to form the phase inversed resin emulsion. A second step of the process for preparing the toner involves aggregating particles in the mixture to a predetermined size. An optional step of the process for preparing the toner involves adding a second phase inversed resin emulsion to the aggregated particles to form a shell thereover. A third step of the process for preparing the toner involves coalescing the particles of the predetermined size to form the toner.

These and other aspects will be discussed in greater detail below.

DETAILED DESCRIPTION OF EMBODIMENTS

The present disclosure provides processes for the preparation of phase inversed resin emulsions and processes for producing toners from such emulsions. In embodiments, one of the processes for preparing the phase inversed resin emulsions of the present disclosure provides an organic solvent-containing phase inversed resin emulsion. In embodiments, another one of the processes for preparing the toners of the present disclosure utilizes one or more organic solvent-containing phase inversed resin emulsions. In embodiments, although the organic solvent-containing phase inversed resin emulsions are produced more efficiently than conventionally known, they are still capable of providing toners exhibiting excellent charging and blocking characteristics as compared to toners prepared utilizing organic solvent-stripped phase inversed resin emulsions.

Resins

Any resin may be utilized in forming the phase inversed resin emulsions of the present disclosure. In embodiments, the resin may be a polyester resin. Suitable polyester resins include those described in U.S. Pat. Nos. 6,593,049 and 6,756,176, the disclosures of each of which are hereby incorporated by reference in their entirety. The resin may be an amorphous resin, a crystalline resin, or a mixture of crystalline and amorphous resins. The resin may be an amorphous polyester resin, a crystalline polyester resin, or a mixture of crystalline polyester and amorphous polyester resins. The resin may be a mixture of a first amorphous polyester resin, a second amorphous polyester resin and a crystalline polyester resin. Suitable resins include a mixture of an amorphous polyester resin and a crystalline polyester resin as described in U.S. Pat. No. 6,830,860, the disclosure of which is hereby incorporated by reference in its entirety.

Crystalline Resin

The resin may be a crystalline polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol, combinations thereof, and the like including their structural isomers. The aliphatic diol may be, for example, selected in an amount of from about 40 to about 60 mole percent of the resin, in embodiments from about 42 to about 55 mole percent of the resin, or in embodiments from about 45 to about 53 mole percent of the resin, and a second diol may be selected in an amount of from about 0 to about 10 mole percent of the resin, in embodiments from about 1 to about 4 mole percent of the resin.

Examples of organic diacids or diesters including vinyl diacids or vinyl diesters selected for the preparation of crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, in embodiments from about 40 to about 60 mole percent of the resin, in embodiments from about 42 to about 52 mole percent of the resin, or in embodiments from about 45 to about 50 mole percent of the resin, and a second diacid can be selected in an amount of from about 0 to about 10 mole percent of the resin.

Polycondensation catalysts which may be utilized in forming either crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), polypropylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate), and mixtures thereof. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), poly(propylene-sebecamide), and mixtures thereof. Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), poly(butylene-succinimide), and mixtures thereof.

In embodiments, the crystalline polyester resin has the following formula (I)

(I)

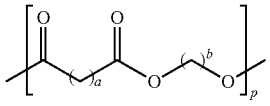

wherein each of a and b may range from 1 to 12, in embodiments from 2 to 12, or in embodiments from 4 to 12 and further wherein p may range from 10 to 100, in embodiments 20 to 80, or in embodiments from 30 to 60. In embodiments, the crystalline polyester resin is poly(1,6-hexylene-1,12-dodecanoate), which may be generated by the reaction of dodecanedioc acid and 1,6-hexanediol.

As noted above, the disclosed crystalline polyester resins may be prepared by a polycondensation process by reacting suitable organic diols and suitable organic diacids in the presence of polycondensation catalysts. A stoichiometric equimolar ratio of organic diol and organic diacid may be utilized, however, in some instances where the boiling point of the organic diol is from about 180° C. to about 230° C., an excess amount of diol, such as ethylene glycol or propylene glycol, of from about 0.2 to 1 mole equivalent, can be utilized and removed during the polycondensation process by distillation. The amount of catalyst utilized may vary, and can be selected in amounts, such as for example, from about 0.01 to about 1, or from about 0.1 to about 0.75 mole percent of the crystalline polyester resin.

The crystalline resin may be present, for example, in an amount of from about 1% to about 85% by weight of the toner components, in embodiments from about 5% to about 50% by weight of the toner components, or in embodiments from about 10% to about 35% by weight of the toner components.

The crystalline resin can possess various melting points of, for example, from about 30° C. to about 120° C., in embodiments from about 50° C. to about 90° C., or in embodiments from about 60° C. to about 80° C. The crystalline resin may have a number average molecular weight ($M_n$), as measured by gel permeation chromatography (GPC) of, for example, from about 1,000 to about 50,000, in embodiments from about 2,000 to about 25,000, or in embodiments from about 5,000 to about 20,000, and a weight average molecular weight ($M_w$) of, for example, from about 2,000 to about 100,000, in embodiments from about 3,000 to about 80,000, or in embodiments from about 10,000 to about 30,000, as determined by GPC. The molecular weight distribution ($M_w/M_n$) value, also known as polydispersity index (PDI), of the crystalline resin may be, for example, from about 2 to about 6, in embodiments from about 3 to about 5, or in embodiments from about 2 to about 4.

Amorphous Resin

The resin may be an amorphous polyester resin formed by reacting a diol with a diacid in the presence of an optional catalyst. Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, trimellitic acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethyl succinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, in embodiments from about 42 to about 52 mole percent of the resin, or in embodiments from about 45 to about 50 mole percent of the resin.

Examples of diols which may be utilized in generating an amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diols selected may vary, for example, the organic diols may be present in an amount from about 40 to about 60 mole percent of the resin, in embodiments from about 42 to about 55 mole percent of the resin, or in embodiments from about 45 to about 53 mole percent of the resin.

Examples of suitable amorphous resins include polyesters, polyamides, polyimides, polyolefins, polyethylene, polybutylene, polyisobutyrate, ethylene-propylene copolymers, ethylene-vinyl acetate copolymers, polypropylene, and the like, and mixtures thereof.

An unsaturated amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

A suitable polyester resin may be an amorphous polyester such as a poly(propoxylated bisphenol A co-fumarate) resin. Examples of such resins and processes for their production include those disclosed in U.S. Pat. No. 6,063,827, the disclosure of which is hereby incorporated by reference in its entirety.

Suitable polyester resins include amorphous acidic polyester resins. An amorphous acid polyester resin may be based on any combination of propoxylated bisphenol A, ethoxylated bisphenol A, terephthalic acid, fumaric acid, and dodecenyl succinic anhydride, such as poly(propoxylated bisphenol-co-terephthlate-fumarate-dodecenylsuccinate). Another amorphous acid polyester resin which may be used is poly(propoxylated-ethoxylated bisphenol-co-terephthalate-dodecenylsuccinate-trimellitic anhydride).

An example of a linear propoxylated bisphenol A fumarate resin which may be utilized as a resin is available under the trade name SPAMII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

An amorphous resin or combination of amorphous resins may be present, for example, in an amount of from about 5% to about 95% by weight of the toner components, in embodiments from about 30% to about 90% by weight of the toner components, or in embodiments from about 35% to about 85% by weight of the toner components.

The amorphous resin or combination of amorphous resins utilized in the phase inversed resin emulsion may have a glass transition temperature of from about 30° C. to about 80° C., in embodiments from about 35° C. to about 70° C., or in embodiments from about 40° C. to about 65° C. The combined resins utilized in the phase inversed resin emulsion may have a melt viscosity of from about 10 to about 1,000,000 Pa*S at about 130° C., in embodiments from about 20 to about 1,000,000 Pa*S at about 130° C., or in embodiments from about 50 to about 100,000 Pa*S at about 130° C. The amorphous resin may have a number average molecular weight ($M_n$), as measured by gel permeation chromatography (GPC) of, for example, from about 1,000 to about 50,000, in embodiments from about 2,000 to about 25,000, or in embodiments from about 1,000 to about 10,000, and a weight average molecular weight ($M_w$) of, for example, from about 2,000 to about 100,000, in embodiments from about 5,000 to about 90,000, in embodiments from about 10,000 to about 90,000, in embodiments from about 10,000 to about 30,000, or in embodiments from about 70,000 to about 100,000, as determined by GPC.

One, two, or more resins may be used. Where two or more resins are used, the resins may be in any suitable ratio (e.g., weight ratio) such as for instance of from about 1% (first resin)/99% (second resin) to about 99% (first resin)/1% (second resin), in embodiments from about 10% (first resin)/90% (second resin) to about 90% (first resin)/10% (second resin). Where the resins include a combination of amorphous and crystalline resins, the resins may be in a weight ratio of, for example, from about 1% (crystalline resin)/99% (amorphous resin) to about 99% (crystalline resin)/1% (amorphous resin), or in embodiments from about 10% (crystalline resin)/90% (amorphous resin) to about 90% (crystalline resin)/10% (amorphous resin). In some embodiments, the weight ratio of the resins is from about 80% to about 60% of the amorphous resin and from about 20% to about 40% of the crystalline resin. In such embodiments, the amorphous resin may be a combination of amorphous resins, e.g., a combination of two amorphous resins.

Suitable crystalline resins which may be utilized, optionally in combination with an amorphous resin as described above, include those disclosed in U.S. Pat. No. 7,329,476, the disclosure of which is hereby incorporated by reference in its entirety. In embodiments, a suitable crystalline resin includes a resin formed of ethylene glycol and a mixture of dodecanedioic acid and fumaric acid co-monomers.

In embodiments, a poly(propoxylated bisphenol A co-fumarate) resin is combined with a crystalline resin formed of ethylene glycol and a mixture of dodecanedioic acid and fumaric acid co-monomers.

In embodiments, a crystalline polyester resin of formula I (e.g., poly(1,6-hexylene-1,12-dodecanoate)) is combined with a high molecular weight amorphous acidic polyester resin (e.g., poly(propoxylated-ethoxylated bisphenol-co-terephthalate-dodecenylsuccinate-trimellitic anhydride)) and with a low molecular weight amorphous acidic polyester resin (e.g., poly(propoxylated bisphenol-co-terephthlate-fumarate-dodecenylsuccinate)). In such embodiments, the crystalline polyester resin has a $M_n$ as measured by GPC of, for example, from about 1,000 to about 30,000, in embodiments from about 1,000 to about 25,000, or in embodiments from about 1,000 to about 20,000 and a $M_w$ of, for example, from about 1,000 to about 40,000, in embodiments from about 5,000 to about 35,000, or in embodiments from about 10,000 to about 30,000 as determined by GPC using polystyrene standards. In such embodiments, the high molecular weight amorphous acidic polyester resin has a $M_n$ as measured by GPC of, for example, from about 1,000 to about 25,000, in embodiments from about 1,000 to about 20,000, or in embodiments from about 1,000 to about 15,000 and a $M_w$ of, for example, from about 65,000 to about 105,000, in embodiments from about 70,000 to about 100,000, or in embodiments from about 75,000 to about 95,000 as determined by GPC using polystyrene standards. In such embodiments, the low molecular weight amorphous acidic polyester resin has a $M_n$ as measured by GPC of, for example, from about 1,000 to about 25,000, in embodiments from about 1,000 to about 20,000, or in embodiments from about 1,000 to about 15,000 and a $M_w$ of, for example, from about 1,000 to about 40,000, in embodiments from about 5,000 to about 35,000, or in embodiments from about 10,000 to about 30,000 as determined by GPC using polystyrene standards. The other properties (e.g., $T_g$, $T_m$, etc.) of the high molecular weight amorphous polyester resin, the low molecular weight amorphous polyester resin and the crystalline polyester resin may be those as described above.

The resin may possess acid groups which may be present at the terminal of the resin. Acid groups which may be present include carboxylic acid groups, and the like. The number of carboxylic acid groups may be controlled by adjusting the materials utilized to form the resin and reaction conditions.

In embodiments, the amorphous resin is a polyester resin having an acid number from about 2 mg KOH/g of resin to about 200 mg KOH/g of resin, in embodiments from about 5 mg KOH/g of resin to about 50 mg KOH/g of resin. The acid containing resin may be dissolved in tetrahydrofuran solution. The acid number may be detected by titration with KOH/methanol solution containing phenolphthalein as the indicator. The acid number may then be calculated based on the equivalent amount of KOH/methanol required to neutralize all the acid groups on the resin identified as the end point of the titration.

Solvent

Any suitable organic solvent may be used in preparing the phase inversed resin emulsions of the present disclosure, for example, alcohols, esters, ethers, ketones, amines, the like, and combinations thereof, in an amount of, for example, from about 0.1% to about 100% by weight of the resin, in embodiments from about 2% to about 50% by weight of the resin, or in embodiments from about 5% to about 35% by weight of the resin.

In embodiments, suitable organic solvents include, for example, methanol, ethanol, propanol, isopropanol, butanol, ethyl acetate, methyl ethyl ketone, and the like, and combinations thereof. In embodiments, the organic solvent may be immiscible in water and may have a boiling point of from about 30° C. to about 100° C.

Any suitable organic solvent above may also be used as a phase or solvent inversion agent, and may be utilized in an amount of from about 1% to about 25% by weight of the resin, in embodiments, from about 5% to about 20% by weight of the resin.

Neutralizing Agent

A neutralizing agent may be used in preparing the phase inversed resin emulsions of the present disclosure. The neutralizing agent may be used to neutralize acid groups in the resins, so a neutralizing agent throughout this specification may also be referred to as a "basic neutralization agent." Any suitable basic neutralization reagent may be used. In embodiments, suitable basic neutralization agents include both inorganic basic agents and organic basic agents. Suitable basic neutralization agents may include ammonium hydroxide, potassium hydroxide, sodium hydroxide, sodium carbonate, sodium bicarbonate, lithium hydroxide, potassium carbonate, combinations thereof, and the like. Suitable basic neutralizing agents may also include monocyclic compounds and polycyclic compounds having at least one nitrogen atom, such as, for example, secondary amines, which include aziridines, azetidines, piperazines, piperidines, pyridines, bipyridines, terpyridines, dihydropyridines, morpholines, N-alkylmorpholines, 1,4-diazabicyclo[2.2.2]octanes, 1,8-diazabicycloundecanes, 1,8-diazabicycloundecenes, dimethylated pentylamines, trimethylated pentylamines, pyrimidines, pyrroles, pyrrolidines, pyrrolidinones, indoles, indolines, indanones, benzindazones, imidazoles, benzimidazoles, imidazolones, imidazolines, oxazoles, isoxazoles, oxazolines, oxadiazoles, thiadiazoles, carbazoles, quinolines, isoquinolines, naphthyridines, triazines, triazoles, tetrazoles, pyrazoles, pyrazolines, and combinations thereof. The monocyclic and polycyclic compounds may be unsubstituted or substituted at any carbon position on the ring.

The basic neutralizing agent may be utilized in an amount of from about 0.001% by weight to 50% by weight of the resin, in embodiments from about 0.01% by weight to about 25% by weight of the resin, in embodiments from about 0.1% by weight to 5% by weight of the resin. The neutralizing agent may be added in the form of an aqueous solution, or in embodiments, in the form of a solid.

Utilizing the above basic neutralizing agent in combination with a resin possessing acid groups, a neutralization ratio of from about 25% to about 500% may be achieved, in embodiments from about 50% to about 300%. In embodiments, the neutralization ratio is calculated as using the following equation: Neutralization ratio in an equivalent amount of 10% $NH_3$/resin(g)/resin acid value/0.303*100.

As noted above, the basic neutralization agent may be added to a resin possessing acid groups. The addition of the basic neutralization agent may thus raise the pH of an emulsion including a resin possessing acid groups from about 5 to about 12, in embodiments, from about 6 to about 11. The neutralization of the acid groups may enhance formation of a resin emulsion.

Surfactants

A surfactant may be used in preparing the phase inversed resin emulsions of the present disclosure. Where utilized, a resin emulsion may include one, two, or more surfactants. The surfactants may be selected from ionic surfactants and nonionic surfactants. Anionic surfactants and cationic surfactants are encompassed by the term "ionic surfactants." The surfactant may be added as a solid or as a solution with a concentration of from about 5% to about 100% (pure surfactant) by weight, in embodiments, from about 10% to about 95% by weight. In embodiments, the surfactant is present in an amount of from about 0.01% to about 20% by weight of the resin, in embodiments, from about 0.1% to about 16% by weight of the resin, in other embodiments, from about 1% to about 14% by weight of the resin.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecylbenzene sulfonates. Combinations of these surfactants may be utilized.

Examples of cationic surfactants include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof. Combinations of these surfactants and any of the foregoing surfactants may be utilized.

Examples of nonionic surfactants include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F and SYNPERONIC PE/F 108. Combinations of these surfactants and any of the foregoing surfactants may be utilized.

Phase Inversed Resin Emulsion Preparation

A process of preparing a phase inversed resin emulsion of the present disclosure may be a solvent-based phase inversion emulsification (PIE) process. The process may include combining at least one resin (e.g., one, two, three, etc.) with an organic solvent at an elevated temperature to dissolve the resin and form a resin mixture. Any of the resins and organic solvents described above may be used in any of the amounts described above. As described above, the resin may be an amorphous resin, a crystalline resin, or a combination thereof, including an amorphous polyester resin, a crystalline polyester resin, or a combination thereof. A combination may include a high molecular weight amorphous acidic polyester resin (e.g., poly(propoxylated-ethoxylated bisphenol-co-terephthalate-dodecenylsuccinate-trimellitic anhydride)), a low molecular weight amorphous acidic polyester resin (e.g., poly(propoxylated bisphenol-co-terephthlate-fumarate-dodecenylsuccinate)) and a crystalline polyester resin of formula I (e.g., poly(1,6-hexylene-1,12-dodecanoate)).

In embodiments, the resin may be an amorphous resin and the elevated temperature may be a temperature above the glass transition temperature of the resin. In other embodiments, the resin may be a crystalline resin and the elevated temperature may be a temperature above the melting point of the resin. In further embodiments, the resin may be a mixture of amorphous and crystalline resins and the elevated temperature may be above the glass transition temperature of the mixture. Suitable elevated temperatures include from about 25° C. to about 90° C., or in embodiments from about 30° C. to about 85° C. The elevated temperature may be attained by slowly or incrementally increasing the temperature until the elevated temperature is achieved.

While the temperature is maintained in the aforementioned range, a solvent inversion agent may be added to the mixture. Any of the solvent inversion agents described above may be used in the amounts described above.

A neutralizing agent may be added to the heated, resin mixture. Any of the neutralizing agents described above may be used in the amounts described above. The addition of the neutralizing agent may be useful where the resin possesses acid group. The neutralizing agent can neutralize the acidic groups of the resin, thereby facilitating phase inversion of the resin mixture. Prior to addition, the neutralizing agent may be at any suitable temperature, including room temperature or an elevated temperature, for example, the elevated temperature described above. Where the neutralizing agent is added as an aqueous solution, it may be added to the heated resin mixture at least until phase inversion is achieved. The neutralizing agent may be metered into the heated mixture at a rate of from about 0.01% to about 10% every 10 minutes, in embodiments, from about 0.5% to about 5% every 10 minutes, or in embodiments from about 1% to about 4% every 10 minutes (the percentages are by weight of the neutralizing agent to be added). The rate of addition need not be constant, but can be varied. In embodiments, the neutralizing agent is added in a single step. This is by contrast to the multi-step, partial neutralization process described in U.S. Pat. No. 9,201,321.

Water (e.g., deionized water) may be added to the heated resin mixture. The water may be added to the heated resin mixture at least until phase inversion is achieved. The water may be metered into the heated resin mixture at a rate of from about 0.01% to about 10% every 10 minutes, in embodiments, from about 0.5% to about 5% every 10 minutes, or in embodiments from about 1% to about 4% every 10 minutes (the percentages are by weight of the water to be added). The rate of addition need not be constant, but can be varied. The addition of water may take place after the addition of the neutralizing agent (if utilized).

A surfactant may be added to facilitate phase inversion of the resin mixture. Any of the surfactants described above may be used in any of the amounts described above. The surfactant may be added before, during, or after the dissolution of the resin in organic solvent. The surfactant may be added before, during, or after the addition of the neutralizing agent. The surfactant may be added with the addition of water.

Stirring may be utilized to facilitate phase inversion. Any suitable stirring device may be utilized. The stirring need not be at a constant speed, but may be varied. For example, as the heating of the resin mixture becomes more uniform, the stirring rate may be increased. In embodiments, the stirring may be at from about 10 revolutions per minute (rpm) to about 5,000 rpm, in embodiments from about 20 rpm to about 2,000 rpm, or in embodiments from about 50 rpm to about 1,000 rpm. In embodiments, a homogenizer (that is, a high shear device), may be utilized to form the phase inversed resin emulsion, but in other embodiments, the process of the present disclosure may take place without the use of a homogenizer. Where utilized, a homogenizer may operate at a rate of from about 3,000 rpm to about 10,000 rpm.

Emulsification and phase inversion of the resin mixture may be accomplished by continuing to add the aqueous solution of the neutralizing agent, the surfactant, and/or the water to create a phase inversed resin emulsion including droplets or particles (containing the resin and organic solvent) dispersed within an aqueous continuous phase. In embodiments utilizing an aqueous solution of a neutralizing agent and/or an aqueous solution of a surfactant, the water added to the resin mixture can be the water present in those aqueous solutions. Alternatively, separate water may be added. Phase inversion may be confirmed by, for example, measuring via any of the techniques within the purview of those skilled in the art.

Although the point of phase inversion may vary depending on the components of the resin emulsion, the temperature of heating, the stirring speed, and the like, phase inversion may occur when the neutralizing agent, surfactant, and/or water has been added so that the resin is present in an amount from about 5% to about 70% by weight of the phase inversed resin emulsion, in embodiments from about 20% to about 65% by weight of the phase inversed resin emulsion, in embodiments from about 30% to about 60% by weight of the phase inversed resin emulsion, or in embodiments from about 5% to about 20% by weight of the phase inversed resin emulsion.

Following phase inversion, additional surfactant, water, and/or aqueous alkaline solution may be added to dilute the phase inversed resin emulsion, although this is not required. Following phase inversion, the phase inversed resin emulsion may be cooled to room temperature. In some embodiments, the cooling step takes place immediately after formation of the phase inversed resin emulsion. In some embodiments, the dilution step takes place immediately after formation of the phase inversed resin emulsion and then, the diluted phase inversed resin emulsion is immediately cooled. By "immediately," it is meant that no intervening additional steps occur.

In embodiments, the process of preparing the phase inversed resin emulsions of the present disclosure includes retaining the organic solvent in the phase inversed resin emulsion to provide an organic solvent-containing phase inversed resin emulsion. In such embodiments, the process of preparing the phase inversed resin emulsion excludes subjecting the phase inversed resin emulsion to an organic solvent removal technique (e.g., distillation) in order to remove the organic solvent from the phase inversed resin emulsion. In embodiments, the process of preparing such an organic solvent-containing phase inversed resin emulsion can include any number of additional steps prior to utilizing the phase inversed resin emulsion as a raw material in a subsequent process (e.g., a process for preparing particles or a toner process), but those additional steps do not substantially reduce the level of organic solvent in the organic solvent-containing phase inversed resin emulsion. By "do not substantially reduce," it is meant that the levels of organic solvent in the organic solvent-containing phase inversed resin emulsion prior to, and after, the additional steps are within, for example, within ±15%, ±10%, ±5%, or ±1%. The amount of organic solvent in the organic solvent-containing phase inversed resin emulsion may be greater than about 100 ppm of the phase inversed resin emulsion, in embodiments greater than 200 ppm of the phase inversed resin emulsion, in embodiments greater than 300 ppm of the phase inversed resin emulsion, or in embodiments greater than 400 ppm of the phase inversed resin emulsion. In embodiments, the amount of organic solvent in the organic solvent-containing phase inversed resin emulsion is at least 20 pph of the phase inversed resin emulsion, in embodiments at least 30 pph of the phase inversed resin emulsion, or in embodiments at least 40 pph of the phase inversed resin emulsion. In embodiments, the amount of organic solvent in the organic solvent-containing phase inversed resin emulsion is in the range of from about 20 pph to about 80 pph of the phase inversed resin emulsion, in embodiments from about 30 pph to about 70 pph of the phase inversed resin emulsion, or in embodiments from about 40 pph to about 60 pph of the phase inversed resin emulsion.

Processes of preparing the phase inversed resin emulsions of the present disclosure which include retaining the organic solvent in the phase inversed resin emulsion are in contrast to conventional processes of preparing phase inversed resin emulsions which include a step of removing the organic solvent via an organic solvent removal technique to provide phase inversed resin emulsion "stripped" of the organic solvent. Such phase inversed resin emulsions may be referred to throughout this specification as "organic solvent-stripped phase inversed resin emulsions". Such conventional processes utilize organic solvent-stripped phase inversed resin emulsions to prevent the organic solvents from negatively affecting the toner formation and toner properties. Although relatively small amounts of the organic solvent may be removed during the phase inversion emulsification process itself, in embodiments which include retaining the organic solvent in the phase inversed resin emulsion, the resulting phase inversed resin emulsion is characterized by significantly greater amounts of organic solvent as compared to a phase inversed resin emulsion prepared according to the same process but which includes subjecting the phase inversed resin emulsion to an organic solvent removal technique.

In embodiments, the emulsified resin particles of the phase inversed resin emulsions described above have a volume average particle size of from about 180 nm to about 240 nm, in embodiments from about 170 nm to about 230 nm, or in embodiments from about 160 nm to about 220 nm. The volume average particle size may be determined by any suitable technique and apparatus, including via a measuring instrument such as a Beckman Coulter Multisizer 3.

In embodiments, the process of preparing an organic solvent-containing phase inversed resin emulsion according to the present disclosure is characterized by a phase inversed resin emulsion cycle time (the time to prepare the phase inversed resin emulsion) in the range of from about 5 hours to about 9 hours, in embodiments from about 6 hours to about 8 hours, or in embodiments, about 7 hours.

Any of the phase inversed resin emulsions described above, including the organic solvent-containing phase inversed resin emulsions, may then be utilized as a raw material in a subsequent process, e.g., a toner process to produce a toner. In accordance with the present disclosure, it has been found that use of one or more organic solvent-containing phase inversed resin emulsions in the preparation of a toner provides a toner having equivalent or superior charging and blocking characteristics as compared to a toner prepared using the same process and the same phase inversed resin emulsion but which has been stripped of organic solvent (i.e., an organic solvent-stripped phase inversed resin emulsion). Besides toner processes, the phase inversed resin emulsions described above may be utilized as a raw material to produce other products, e.g., paints, inks, etc.

The process of preparing an organic solvent-containing phase inversed resin emulsion may further include a step of packaging the organic solvent-containing phase inversed resin emulsion prior to utilizing the organic solvent-containing phase inversed resin emulsion as a raw material. The packaging may be that which is suitable for shipping the organic solvent-containing phase inversed resin emulsion to a location where a toner process is carried out. Thus, the processes of the present disclosure may include offering for sale any of the phase inversed resin emulsions, including the organic solvent-containing phase inversed resin emulsions. For example, a process may include forming the organic solvent-containing phase inversed resin emulsion and offering for sale the organic solvent-containing phase inversed resin emulsion.

In embodiments, the process of preparing a phase inversed resin emulsion of the present disclosure does not include utilizing a silicone free anti-foam agent, e.g., those agents disclosed in U.S. Pat. No. 8,741,534. In embodiments, the process of preparing a phase inversed resin emulsion of the present disclosure does not utilize a micromixer, e.g., those micromixers disclosed in U.S. Pat. No. 7,943,687.

Toner

Once the resin (or mixture of two or more resins, e.g., 3 resins) has been converted into a phase inversed resin emulsion as described above, it may be utilized as a raw material to form a toner by any process within the purview of those skilled in the art, such as an emulsion aggregation and coalescence process.

The toner may include colorant, wax, and other additives. The optional additional ingredients of the toner may be added before, during or after mixing the resin of the phase inversed resin emulsion. The optional additional ingredients may be added before, during or after formation of the phase inversed resin emulsion. In embodiments, the optional additional ingredients are added after formation of the phase inversed resin emulsion, optionally as separate dispersions.

Colorants

Various known suitable colorants may be included in the toner. The term "colorant" refers, for example, to pigments, dyes, mixtures thereof, such as mixtures of dyes, mixtures of pigments, mixtures of dyes and pigments, and the like. The colorant may be present in the toner in an amount of, for example, in embodiments from about 0.1% to about 35% by weight of the toner, in embodiments from about 1% to about 20% by weight of the toner, or in embodiments from about 5% to about 15% by weight of the toner, although the amount of colorant can be outside of these ranges.

As examples of suitable colorants, mention may be made of carbon black like REGAL 330® (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S(Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871 K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991 K (BASF), Paliotol Yellow 1840 (BASF), Novaperm Yellow FGL (Hoechst), Permanerit Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations of the foregoing, and the like.

Other suitable water based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850: 1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlrich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

The colorant may include a pigment, a dye, combinations thereof, carbon black, magnetite, black, cyan, magenta, yellow, red, green, blue, brown, combinations thereof, in an amount sufficient to impart the desired color to the toner. It is to be understood that other useful colorants will become readily apparent based on the present disclosure.

A pigment or colorant may be employed in an amount of from about 1% by weight to about 35% by weight of the toner particles on a solids basis, in other embodiments, from about 5% by weight to about 25% by weight. However, amounts outside these ranges can also be used.

Wax

Optionally, a wax may also be combined with the resin and a colorant in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, in embodiments from about 1% to about 25% by weight of the toner particles, or in embodiments from about 5% to about 20% by weight of the toner particles. However, amounts outside these ranges can also be used.

When a wax is used, the wax may include any of the various waxes conventionally used in emulsion aggregation toner compositions. Waxes that may be selected include waxes having, for example, an average molecular weight of from about 500 to about 20,000, in embodiments from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polymethylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethylene glycol monostearate, dipropylene glycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be in the range of from about 100 to about 300 nm.

Toner Preparation

The toner particles may be prepared by any process within the purview of one skilled in the art. Although embodiments relating to toner production are described below with respect to emulsion aggregation (EA) processes, any suitable process of preparing toner may be used, including chemical processes, such as suspension and encapsulation processes disclosed in U.S. Pat. Nos. 5,290,654 and 5,302,486, the disclosures of each of which are hereby incorporated by reference in their entirety.

In embodiments, the toner particles are prepared by EA processes, such as a process that includes aggregating a mixture of a wax, a colorant, and a phase inversed resin emulsion containing at least one resin as described above, and then coalescing the mixture. One or more phase inversed resin emulsions may be used, e.g., multiple phase inversed resin emulsions. Each phase inversed resin emulsion of the multiple phase inversed resin emulsions may contain one resin. The relative ratios of the different phase inversed resin emulsions may vary as described above with respect to individual resins in a resin mixture. In embodiments, at least one of the phase inversed resin emulsions utilized to form a toner is an organic solvent-containing phase inversed resin emulsion. In embodiments, all of the phase inversed resin emulsions utilized to form a toner are organic solvent-containing phase inversed resin emulsions. The organic solvent-containing phase inversed resin emulsions may be those prepared as described above. However, other organic solvent-containing phase inversed resin emulsions may be used, e.g., those prepared utilizing other processes or commercially available organic solvent-containing phase inversed resin emulsions. However, such other organic solvent-containing phase inversed resin emulsions may be characterized by the same levels of organic solvent as described above.

In embodiments, a first phase inversed resin emulsion containing a first amorphous polyester resin (e.g., a high molecular weight amorphous acidic polyester resin such as poly(propoxylated-ethoxylated bisphenol-co-terephthalate-dodecenylsuccinate-trimellitic anhydride)), a second phase inversed resin emulsion containing a second amorphous polyester resin (e.g., a low molecular weight amorphous acidic polyester resin such as poly(propoxylated bisphenol-co-terephthlate-fumarate-dodecenylsuccinate)) and a third phase inversed resin emulsion containing a crystalline polyester resin (e.g., one having formula I such as poly(1,6-hexylene-1,12-dodecanoate)) are used to form a toner. In such embodiments, the weight ratio of the phase inversed resin emulsions used to form the toner is from about 80% to about 60% of the first and second phase inversed resin emulsions (which may each be present in substantially equal amounts) and from about 20% to about 40% of the third phase inversed resin emulsion. The properties (e.g., $M_n$, $M_w$, $T_g$, $T_m$, etc.) of the high molecular weight amorphous polyester resin, the low molecular weight amorphous polyester resin and the crystalline polyester resin may be those as described above.

The wax, the colorant, etc. may be utilized in an aqueous dispersion containing, for example, any of the surfactants described above. The mixture may be homogenized. Homogenization may be accomplished by mixing at about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized. Suitable aggregating agents include, for example, aqueous solutions of a divalent cation or a multivalent cation material. The aggregating agent may be, for example, an inorganic cationic aggregating agent such as a polyaluminum halide such as polyaluminum chloride (PAC), or the corresponding bromide, fluoride, or iodide; a polyaluminum silicate such as polyaluminum sulfosilicate (PASS); or a water soluble metal salt including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, and copper sulfate; or combinations thereof. The aggregating agent may be added to the mixture at a temperature that is below the glass transition temperature ($T_g$) of the resin. The aggregating agent may be added to the mixture under homogenization.

The aggregating agent may be added to the mixture utilized to form a toner in an amount of, for example, from about 0% to about 10% by weight of the resin, in embodiments from about 0.2% to about 8% by weight of the resin, in other embodiments from about 0.5% to about 5% by weight of the resin.

The particles of the mixture may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for volume average particle size. The aggregation thus may proceed by maintaining an elevated temperature, or slowly raising the temperature to, for example, in embodiments, from about 30° C. to about 100° C., in embodiments from about 30° C. to about 80° C., or in embodiments from about 30° C. to about 50° C. The temperature may be held for a period time of from about 0.5 hours to about 6 hours, or in embodiments from about hour 1 to about 5 hours, while stirring, to provide the aggregated particles. Once the predetermined desired particle size is reached, a shell may be added. The volume average particle size of the particles prior to application of a shell may be, for example, from about 3 μm to about 10 μm, in embodiments, from about 3 μm to about 8 μm, or from about 3 μm to about 6 μm.

Shell Resin

In embodiments, after aggregation, but prior to coalescence, a resin coating may be applied to the aggregated particles to form a shell thereover. Any of the resins described above may be utilized in the shell. In embodiments, an amorphous polyester resin is utilized in the shell, optionally in combination with a crystalline polyester resin. In embodiments, a first resin may be present in the shell in an amount of from about 20% to about 100% by weight of the total shell resin, or in embodiments from about 30% to about 90% by weight of the total shell resin. In embodiments, a second resin may be present in the shell resin in an amount of from about 0% to about 80% by weight of the total shell resin, or in embodiments from about 10% to about 70% by weight of the shell resin. In embodiments, two amorphous polyester resins are utilized in the shell, e.g., in substantially equal amounts. In embodiments, a first amorphous polyester resin (e.g., a high molecular weight amorphous acidic polyester resin such as poly(propoxylated-ethoxylated bisphenol-co-terephthalate-dodecenylsuccinate-trimellitic anhydride)) and a second amorphous polyester resin (e.g., a low molecular weight amorphous acidic polyester resin such as poly(propoxylated bisphenol-co-terephthlate-fumarate-dodecenylsuccinate)) are utilized in the shell.

The shell resin may be applied to the aggregated particles by any process within the purview of those skilled in the art. The resin may be utilized in the form of any of the phase inversed resin emulsions described above, including organic solvent-containing phase inversed resin emulsions. However, in some embodiments, the shell resin is utilized as an organic solvent-stripped phase inversed resin emulsion. Such phase inversed resin emulsions may be combined with the aggregated particles described above under conditions sufficient to form the shell over the aggregated particles. For example, the formation of the shell over the aggregated particles may occur while heating to a temperature of from about 30° C. to about 80° C., or in embodiments from about 35° C. to about 70° C. The formation of the shell may take place for a period of time from about 5 minutes to about 10 hours, or in embodiments from about 10 minutes to about 5 hours.

Once the desired size of the toner particles is achieved, the pH of the mixture may be adjusted with a pH control agent, e.g., a base, to a value of from about 3 to about 10, or in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, a chelating agent such as ethylene diamine tetraacetic acid (EDTA) may be added to help adjust the pH to the desired values noted above. Other chelating agents may be used.

In embodiments, the size of the core-shell toner particles (prior to coalescence) may be from about 2 μm to about 12 μm, in embodiments of from about 3 μm to about 10 μm, or in embodiments of from about 4 μm to about 8 μm.

Coalescence

Following aggregation to the desired particle size and application of any optional shell, the particles may then be coalesced to the desired final shape, the coalescence being achieved by, for example, heating the mixture to a temperature of from about 45° C. to about 150° C., in embodiments from about 55° C. to about 99° C., or in embodiments from about 60° C. to about 90° C., which may be at or above the glass transition temperature of the resins utilized to form the toner particles. Next, the pH of the mixture may be adjusted (e.g., reduced) over a period of time to reach the desired circularity. The period of time may be from about 1 hours to about 5 hours, or in embodiments from about 2 hours to about 4 hours. Various buffers may be used during coalescence. The total time period for coalescence may be from about 1 to about 9 hours, in embodiments from about 1 to about 8 hours, or in embodiments from about 1 to about 5 hours. Stirring may be utilized during coalescence, for example, from about 20 rpm to about 1000 rpm, or in embodiments from about 30 rpm to about 800 rpm.

After aggregation and/or coalescence, the mixture may be cooled to room temperature. The cooling may be rapid or slow, as desired. A suitable cooling process may include introducing cold water to a jacket around the reactor. After cooling, the toner particles may be optionally washed with water, and then dried. Drying may be accomplished by any suitable process for drying including, for example, freeze-drying.

Additives

In embodiments, the toner particles may also contain other optional additives. For example, the toner may include positive or negative charge control agents. Surface additives may also be used. Examples of surface additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids such as zinc stearate, calcium stearate, and magnesium stearate, mixtures thereof and the like; long chain alcohols such as UNILIN 700; and mixtures thereof.

Each of these surface additives may be present in an amount of from about 0.1% to about 5% by weight of the toner, or in embodiments of from about 0.25% by weight to about 3% by weight of the toner. In embodiments, the toner may include, for example, from about 0.1% to about 5% of titania by weight of the toner, from about 0.1% to about 8% of silica by weight of the toner, from about 0.1% to about 5% of colloidal silica by weight of the toner, from about 0.05% to about 4% of zinc stearate by weight of the toner, and from about 0.1% to about 4% of cerium oxide by weight of the toner.

In embodiments, the dry toner particles, exclusive of external surface additives, exhibit one or more of the following characteristics:

(1) Volume average particle size of from about 3 μm to about 15 μm, in embodiments from about 4 μm to about 10 μm, or in embodiments from about 5 μm to about 8 μm.

(2) Number Average Geometric Size Distribution (GSDn) and/or Volume Average Geometric Size Distribution (GSDv) of from about 1.05 to about 1.55, in embodiments from about 1.10 to about 1.40, or from about 1.10 to about 1.35.

(3) Circularity of from about 0.9 to about 1, in embodiments from about 0.92 to about 0.99, or from about 0.95 to about 0.98 (as measured with, for example, a Sysmex 3000).

As noted above, the characteristics of the toner particles may be determined by any suitable technique and apparatus. With respect to volume average particle size, GSDv, and GSDn, these characteristics may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

Toners produced in accordance with the present disclosure may possess excellent charging characteristics under a variety of relative humidity (RH) conditions, for example, a low-humidity zone (J-zone) of 21.1° C./10% RH and a high humidity zone (A-zone) of about 28° C./85% RH. In embodiments, the toner particles, exclusive of external surface additives, exhibit one or more of the following characteristics:

(1) A-zone charge to diameter ratio (Q/D) of from about −0.10 fC/μm to about −2 fC/μm, in embodiments from about −0.15 fC/μm to about −1 fC/μm, or in embodiments from about −0.20 fC/μm to about −1 fC/μm.

(2) A-zone charge per mass ratio (Q/M) of from about −5 μC/g to about −90 μC/g in embodiments from about −5 μC/g to about −65 μC/g, or in embodiments from about −5 μC/g to about −35 μC/g.

(3) J-zone charge to diameter ratio (Q/D) of from about −0.90 fC/μm to about −20 fC/μm, in embodiments from about −1 fC/μm to about −10 fC/μm, or in embodiments from about −1 fC/μm to about −5 fC/μm.

(4) J-zone charge per mass ratio (Q/M) of from about −30 μC/g to about −600 μC/g in embodiments from about −30 μC/g to about −300 μC/g, or in embodiments from about −30 μC/g to about −150 μC/g.

In embodiments, a toner prepared utilizing at least one organic solvent-containing phase inversed resin emulsion, exclusive of external surface additives, exhibits charging characteristics (e.g., A-zone Q/D, A-zone Q/M, J-zone Q/D, and/or J-zone Q/M) which are substantially the same as the charging characteristics of a comparative toner prepared utilizing organic solvent-stripped phase inversed resin emulsion. By "comparative toner," it is meant a toner which is prepared using the same toner process as the toner prepared utilizing the at least one organic solvent-containing phase inversed resin emulsion and utilizing the same phase inversed resin emulsion except that the phase inversed resin emulsion has been stripped of its organic solvent. By "substantially the same" it is meant that the charging characteristic for each of the two toners are, for example, within ±15%, ±12%, ±10%, ±5%, or ±2%.

The Examples below describe suitable methods for determining the charging characteristics described above, including determination of Q/D values via a charge spectrograph and determination of Q/M values via a total blow-off charge method.

Toners produced in accordance with the present disclosure may exhibit excellent charge maintenance. In embodiments, a toner prepared utilizing at least one organic solvent-containing phase inversed resin emulsion, including external surface additives, exhibits a charging maintenance which is substantially the same as the charging maintenance of a comparative toner prepared utilizing organic solvent-stripped phase inversed resin emulsion. "Comparative toner" and "substantially the same" have the same meaning with respect to charge maintenance as has been described above with respect to charging. The charging maintenance may be determined after 24 hours or 7 days. The Examples below describe a suitable method for determining charging maintenance.

Toners produced in accordance with the present disclosure may exhibit excellent blocking characteristics. In embodiments, a toner prepared utilizing at least one solvent-containing phase inversed resin emulsion, including external surface additives, exhibits an onset blocking temperature which is substantially the same as the onset blocking of a comparative toner prepared utilizing organic solvent-stripped phase inversed resin emulsion. "Comparative toner" and "substantially the same" have the same meaning with respect to onset blocking temperature as has been described above with respect to charging. The Examples below describe a suitable method for determining onset blocking temperature.

Toners produced in accordance with the present disclosure, even toners produced utilizing organic solvent-containing phase inversed resin emulsion(s), may possess low levels of organic solvent. Organic solvent levels may be determined by gas chromatography (GC). In embodiments, a toner prepared utilizing at least one organic solvent-containing phase inversed resin emulsion, exclusive of external surface additives, is characterized by a level of organic solvent of no more than about 50 ppm of the toner, in embodiments no more than about 30 ppm of the toner, in embodiments no more than about 20 ppm of the toner, in embodiments no more than about 10 ppm of the toner, or in embodiments no more than about 5 ppm of the toner. In embodiments, a toner prepared utilizing at least one organic solvent-containing phase inversed resin emulsion, exclusive of external surface additives, is characterized by a level of organic solvent which is substantially the same as the level of organic solvent of a comparative toner prepared utilizing organic solvent-stripped phase inversed resin emulsion. It has been found that these low levels of organic solvent are possible even when the toner cycle time for preparing a toner utilizing an organic solvent-containing phase inversed resin emulsion (exclusive of the phase inversed resin emulsion cycle time for preparing the phase inversed resin emulsion itself) is substantially the same as the toner cycle time for preparing a comparative toner utilizing an organic solvent-stripped phase inversed resin emulsion. "Comparative toner" and "substantially the same" have the same meaning with respect to organic solvent level as has been described above with respect to charging.

By utilizing an organic solvent-containing phase inversed resin emulsion in preparing a toner, the total cycle time for preparing the toner (inclusive of the phase inversed resin emulsion cycle time for preparing the phase inversed resin emulsion itself) is in the range of from about 17 hours to about 27 hours, in embodiments from about 19 hours to about 25 hours, or in embodiments from about 19 hours to about 20 hours. In embodiments, the total cycle time for preparing the toner is about 2 to about 5 times faster than the total cycle time for preparing a comparative toner utilizing an organic solvent-stripped phase inversed resin emulsion. This includes embodiments in which the total cycle time is about 2 to about 4 times faster or about 2 to about 3 times faster. "Comparative toner" has the same meaning with respect to total cycle time as has been described above with respect to charging.

Developers and Carriers

The toners may be formulated into a developer composition. Developer compositions can be prepared by mixing the toners of the present disclosure with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 1% to about 15% by weight of the toner, in embodiments from about 2% to about 8% by weight of the toner, or in embodiments from about 4% to about 6% by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, mixtures thereof and other known components.

Imaging

The toners may be used for electrostatographic or xerographic processes. In embodiments, any known type of image development system may be used in an image developing device, including, for example, magnetic brush development, jumping single component development, hybrid scavengeless development (HSD) and the like. Those and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

EXAMPLES

The following Examples are being submitted to illustrate various embodiments of the present disclosure. These Examples are intended to be illustrative only and are not intended to limit the scope of the present disclosure. Also, parts and percentages are by weight unless otherwise indicated. As used throughout this specification, "room temperature" refers to a temperature of from about 20° C. to about 25° C.

Example 1

This example describes a 50 g preparation of a toner utilizing an organic solvent-containing phase inversed resin emulsion.

A 1 liter glass reactor equipped with an overhead mixer was charged with the following: 32.21 g of an emulsion of amorphous resin A (40.11 wt %) provided by Ortec, Inc.; 32.12 g of an emulsion of amorphous resin B (40.24 wt %) provided by Ortec, Inc.; 24.14 g of an emulsion of crystalline resin (14.47 wt %) provided by Ortec, Inc.; 15.14 g of a wax dispersion (30.47 wt %) (The International Group, Inc.); and 20.20 g of cyan pigment PB15:3 (14.84 wt %). Emulsions of amorphous resin A and amorphous resin B were utilized after solvent stripping, while the emulsion of crystalline resin was utilized prior to solvent stripping. The amounts of organic solvent in each of the emulsions of amorphous resin A and amorphous resin B was less than 300 ppm. The amount of organic solvent in the emulsion of crystalline resin was about 50 pph (i.e., about 50% organic solvent by weight of the emulsion). The organic solvent was a combination of methyl ethyl ketone and isopropyl alcohol. Amorphous resin A was a high molecular weight amorphous acidic polyester resin (poly(propoxylated-ethoxylated bisphenol-co-terephthalate-dodecenylsuccinate-trimellitic anhydride)) having a $M_w$ of about 86,000, a $M_n$ of about 5,600, and a $T_g$ onset of about 56° C. Amorphous resin B was a low molecular weight amorphous acidic polyester resin (poly(propoxylated bisphenol-co-terephthlate-fumarate-dodecenylsuccinate)) having a $M_w$ of about 19,400, a $M_n$ of about 5,000, and a $T_g$ onset of about 60° C. The crystalline resin was a crystalline polyester resin of formula I (poly(1,6-hexylene-1,12-dodecanoate)) having a $M_w$ of about 23,300, a $M_n$ of about 10,500, and a melting temperature ($T_m$) of about 71° C. The emulsions were otherwise prepared according to the solvent-based phase inversion emulsification processes described above.

Separately, 0.89 g of $Al_2(SO_4)_3$ (27.85 wt %) was added in as the flocculent under homogenization. The mixture was heated to 45.0° C. to aggregate the particles while stirring at 420 rpm. The particle size was monitored with a Coulter Counter until the core particles reached a volume average particle size of 4.54 μm with a GSD volume of 1.21. Then, 17.81 g of the above mentioned amorphous resin A emulsion, and 17.76 g of the above mentioned amorphous resin B emulsion were added as shell material, resulting in core-shell structured particles with a volume average particle size of 6.41 microns and GSD volume 1.19. Thereafter, the pH of the reaction slurry was increased to 7.8 using 4 wt % NaOH solution, followed by the addition of 1.92 g EDTA (39 wt %) to stop toner growth. After freezing, the reaction mixture was heated to 85° C. while maintaining the pH at 7.8. Then, the pH was gradually reduced to 7.4 over 3 hours using Tayca and Sodium Acetate buffer to reach the desired circularity. The toner was quenched after coalescence, resulting in a final volume average particle size of 6.34 microns, GSD volume of 1.21, GSD number 1.27, and circularity 0.972. The toner slurry was then cooled to room temperature, separated by sieving (25 μm), filtered, washed, and freeze dried.

Example 2

This example describes a 150 g preparation of a toner utilizing an organic solvent-containing phase inversed resin emulsion.

A 2 liter glass reactor equipped with an overhead mixer was charged with the following: 96.62 g of an emulsion of amorphous resin A (40.11 wt %) provided by Ortec, Inc.; 96.37 g of an emulsion of amorphous resin B (40.24 wt %) provided by Ortec, Inc., 72.41 g of an emulsion of crystalline resin (14.47 wt %) provided by Ortec, Inc.; 45.41 g of a wax dispersion (30.47 wt %) (The International Group, Inc.); and 60.59 g of cyan pigment PB15:3 (14.84 wt %). Emulsions of amorphous resin A and amorphous resin B were utilized after solvent stripping, while the emulsion of crystalline resin was utilized prior to solvent stripping. The amount of organic solvent in each of the emulsions of amorphous resin A and amorphous resin B was less than 300 ppm. The amount of organic solvent in the emulsion of crystalline resin was about 50 pph (i.e., about 50% organic solvent by weight of the emulsion). The organic solvent was a combination of methyl ethyl ketone and isopropyl alcohol. The amorphous resin A, amorphous resin B and crystalline resin used were those described in Example 1. The emulsions were otherwise prepared according to the solvent-based phase inversion emulsification processes described above.

Separately, 2.69 g of $Al_2(SO_4)_3$ (27.85 wt %) was added in as the flocculent under homogenization. The mixture was heated to 35.0° C. to aggregate the particles while stirring at 230 rpm. The particle size was monitored with a Coulter Counter until the core particles reached a volume average particle size of 4.49 μm with a GSD volume of 1.23. Then, 53.44 g of the above mentioned amorphous resin A emulsion, and 53.27 g of the above mentioned amorphous resin B emulsion were added as shell material, resulting in core-shell structured particles with a volume average particle size of 5.77 microns and GSD volume 1.21. Thereafter, the pH of the reaction slurry was increased to 7.8 using 4 wt % NaOH solution followed by 5.77 g EDTA (39 wt %) to stop the toner growth. After freezing, the reaction mixture was heated to 85° C., while maintaining the pH at 7.8. Then, the pH was gradually reduced to 7.0 over 3 hours using Tayca and Sodium Acetate buffer to reach the desired circularity. The toner was quenched after coalescence, resulting in a final volume average particle size of 6.024 microns, GSD volume of 1.21, GSD number 1.29, and circularity 0.968.

The toner slurry was then cooled to room temperature, separated by sieving (25 μm), filtered, washed, and freeze dried.

Example 3

This example describes the evaluation of charging and blocking characteristics of the toner of Example 2. A control toner was also evaluated. The control toner was prepared according to procedure of Example 2 except that the emulsion of crystalline resin was utilized after solvent stripping. Thus, for the control toner, the amounts of organic solvent in each of the emulsions of amorphous resin A, amorphous resin B, and the crystalline resin were less than 300 ppm. The aggregation time, the coalescence time and the toner cycle time were about the same for the control toner and the toner of Example 2. The control toner had a final volume average particle size of 5.654 microns, GSD volume of 1.21, GSD number 1.21, and circularity 0.974.

Toner Additive Blending.

For each sample, about 50 g of the toner was added to an SKM mill along with an additive package including silica, titania and zinc stearate and then blended for about 30 seconds at approximately 12500 rpm. Surface additives were 1.29% RY50L silica, 0.86% RX50 silica, 0.88% STT100H titania, 1.73% X24 sol-gel colloidal silica, and 0.18% zinc stearate, 0.5% PMMA and 0.28% cerium oxide particles.

Toner Charging.

Toner charging was collected for both the parent toner particle (without any surface additives) and for the blended toner particle (with surface additives). For parent toner particles, 5 pph of toner in carrier was prepared utilizing 1.5 grams of toner and 30 grams of XEROX® 700 carrier in a 60 mL glass bottle. For the blended toner, 6 pph of toner in carrier was prepared utilizing 1.8 grams of toner and 30 grams of XEROX® 700 carrier in a 60 mL glass bottle. Samples were conditioned three days in a low-humidity zone (J zone) at 21.1° C./10% relative humidity, and in a separate sample in a high humidity zone (A zone) at about 28° C./85% relative humidity. The developers with parent toner particles were charged in a Turbula mixer for 10 minutes, the developers with additive blended toner were charged in a Turbula mixer for 60 minutes.

The toner charge was measured in the form of Q/D, the charge to diameter ratio. The Q/D was measured using a charge spectrograph having a 100 V/cm field, and was measured visually as the midpoint of the toner charge distribution. The charge was reported in millimeters of displacement from the zero line (mm displacement can be converted to femtocoulombs/micron (fC/μm) by multiplying by 0.092).

The toner charge was also measured as the charge per mass ratio (Q/M) as determined by the total blow-off charge method, measuring the charge on a faraday cage containing the developer after removing the toner by blow-off in a stream of air. The total charge collected in the cage is divided by the mass of toner removed by the blow-off, by weighing the cage before and after blow-off to give the Q/M ratio.

Toner Charge Maintenance.

A developer sample was prepared by weighing 1.8 g of additive blended toner onto 30 g of carrier in a washed 60 ml glass bottle. The developer was conditioned in an A-zone environment of 28° C./85% RH for three days to equilibrate fully. The developer was charged by agitating the sample for two minutes in a Turbula mixer. The charge per unit mass of the sample was measured using a tribo charge blow-off method as described above. The sample was then returned to the A-zone chamber in an idle position. The charge per unit mass measurement was repeated again after 24 hours and 7 days. Charge maintenance is calculated from the 24 h and 7 day charge as a percentage of the initial charge.

Toner Blocking.

Toner blocking was determined by measuring the toner cohesion at elevated temperature above room temperature. Toner blocking measurement was completed as follows: two grams of additive blended toner was weighed into an open dish and conditioned in an environmental chamber at the specified elevated temperature and 50% relative humidity. After about 17 hours the samples were removed and acclimated in ambient conditions for about 30 minutes. Each re-acclimated sample was measured by sieving through a stack of two pre-weighed mesh sieves, which were stacked as follows: 1000 μm on top and 106 μm on bottom. The sieves are vibrated for about 90 seconds at about 1 mm amplitude with a Hosokawa flow tester. After the vibration was completed the sieves are reweighed and toner blocking is calculated from the total amount of toner remaining on both sieves as a percentage of the starting weight. Thus, for a 2 gram toner sample, if A is the weight of toner left on the top 1000 μm screen and B is the weight of toner left on the bottom 106 μm screen, the toner blocking percentage is calculated by: % blocking=50 (A+B). The onset blocking temperature was also determined, which is defined as the temperature at which the measured toner cohesion begins to rapidly increase with temperature.

TABLE 1

Charging and blocking results for control toner and toner of Example 2.

| | A-zone | | J-zone | | Charge Maintenance in A-zone (%) | | Onset of |
|---|---|---|---|---|---|---|---|
| Sample | Q/D (mm) | Q/M (μC/g) | Q/D (mm) | Q/M (μC/g) | 24 h | 7 day | Blocking (° C.) |
| Control (Parent) | −2.3 | −15 | −19.3 | −108 | — | — | — |
| Example 2 (Parent) | −2.5 | −17 | −17.9 | −100 | — | — | — |
| Control (Blended[1]) | −6.7 | −27 | −14.6 | −78 | 76 | 57 | 54.0 |
| Example 2 (Blended[1]) | −5.2 | −29 | −16.7 | −80 | 86 | 63 | 53.0 |

[1]Q/D and Q/M values for blended toner particles determined after mixing with surface additives for 60 minutes.

The results shown in Table 1 demonstrate that the toner of Example 2 substantially matched the control toner for parent toner charging and blended toner charging. Furthermore, charge maintenance is slightly better for the toner of Example 2 as compared to the control toner. Finally, the toner of Examiner 2 passed the blocking evaluation test (the minimum target is 52.5° C.)

Example 4

The toner of Example 2 and the control toner described in Example 3 were analyzed for residual solvents using gas chromatography (GC). Table 2, below, shows the results.

TABLE 2

Residual solvent analysis for control toner and toner of Example 2.

| Sample | Level of IPA (ppm) | Level of MEK (ppm) |
|---|---|---|
| Control Toner | Not detected | Not detected |
| Toner of Example 2 | Not detected | Not detected |

"Not detected" is about 0 ppm. The results shown in Table 2 demonstrate that the toner of Example 2 substantially matched the control toner for amount of organic solvent.

It will be appreciated that variants of the above-disclosed and other features and functions or alternatives thereof, may be combined into many other different systems or applications. Various presently unforeseen or unanticipated alternatives, modifications, variations or improvements therein may be subsequently made by those skilled in the art, which are also intended to be encompassed by the following claims.

What is claimed is:

1. A process for preparing particles comprising:

employing a mixture to form particles wherein the mixture comprises (i) an optional wax, (ii) an optional colorant, and (iii) a phase inversed resin emulsion comprising a resin, water, and an organic solvent, wherein the process for preparing the phase inversed resin emulsion excludes subjecting the phrase inversed resin emulsion to an organic solvent removal technique, thereby retaining the organic solvent in the phase inversed resin emulsion;

aggregating the particles to a predetermined size; and coalescing the particles of the predetermined size, wherein the level of organic solvent in the coalesced particles, exclusive of external additives, is less than about 50 ppm of the coalesced particles.

2. The process of claim 1, further comprising preparing the phase inversed resin emulsion by:

dissolving the resin in the organic solvent to form a resin mixture;

optionally, adding a neutralizing agent to the resin mixture to neutralize acid groups on the resin; and adding a sufficient amount of water to the resin mixture to emulsify and induce phase inversion in the resin mixture to form the phase inversed resin emulsion comprising the resin, water, and the organic solvent.

3. The process of claim 1, wherein the level of organic solvent in the phase inversed resin emulsion is at least 20 pph of the phase inversed resin emulsion.

4. The process of claim 1, wherein the level of organic solvent in the phase inversed resin emulsion is in the range of from about 20 pph to about 80 pph of the phase inversed resin emulsion.

5. The process of claim 2, wherein any additional steps of the process for preparing the phase inversed resin emulsion prior to use of the phase inversed resin emulsion in the method for preparing particles do not substantially reduce the level of organic solvent in the phase inversed resin emulsion.

6. The process of claim 2, further comprising cooling the phase inversed resin emulsion immediately after formation of the phase inversed resin emulsion, or further comprising diluting the phase inversed resin emulsion immediately after formation of the phase inversed resin emulsion and immediately cooling the diluted phase inversed resin emulsion.

7. The process of claim 2, wherein the resin is a polyester resin or a combination of polyester resins.

8. The process of claim 7, wherein the resin is an amorphous polyester resin, a crystalline polyester resin, or a combination thereof.

9. The process of claim 7, wherein the resin is poly (propoxylated-ethoxylated bisphenol-co-terephthalate-dodecenylsuccinate-trimellitic anhydride), poly(propoxylated bisphenol-co-terephthlate-fumarate-dodecenylsuccinate), poly(1,6-hexylene-1,12-dodecanoate), or a combination thereof.

10. A process for preparing a toner comprising:

forming a mixture comprising (i) an optional wax, (ii) a colorant, and (iii) a phase inversed resin emulsion comprising a resin, water, and an organic solvent, wherein the process for preparing the phase inversed resin emulsion excludes subjecting the phrase inversed resin emulsion to an organic solvent removal technique, thereby retaining the organic solvent in the phase inversed resin emulsion;

aggregating particles in the mixture to a predetermined size;

optionally, adding a second phase inversed resin emulsion to the aggregated particles to form a shell thereover; and coalescing the particles of the predetermined size to form the toner, wherein the level of organic solvent in the coalesced particles, exclusive of external additives, is less than about 50 ppm of the coalesced particles.

11. The process of claim 10, wherein the level of organic solvent in the phase inversed resin emulsion is at least 20 pph of the phase inversed resin emulsion.

12. The process of claim 10, wherein the process for preparing each of the phase inversed resin emulsions utilized in the toner excludes subjecting each phase inversed resin emulsion to an organic solvent removal technique, thereby retaining each organic solvent in each phase inversed resin emulsion.

13. The process of claim 10, wherein the process comprises adding the second phase inversed resin emulsion to the aggregated particles to form a shell thereover, wherein the second phase inversed resin emulsion is an organic solvent-stripped phase inversed resin emulsion.

14. The process of claim 10, wherein the level of organic solvent in the toner is substantially the same as the level of organic solvent of a comparative toner prepared utilizing an organic solvent-stripped phase inversed resin emulsion in the step of forming the mixture.

15. The process of claim 10, wherein the toner is characterized by an A-zone Q/D value, an A-zone Q/M value, a J-zone Q/D value, a J-zone Q/M value, an onset blocking temperature value, or a combination thereof which is substantially the same as the respective value of a comparative toner prepared utilizing an organic solvent-stripped phase inversed resin emulsion in the step of forming the mixture.

16. A process for preparing particles comprising:

employing a mixture to form particles wherein the mixture comprises (i) an optional wax, (ii) an optional colorant, and (iii) a phase inversed resin emulsion comprising a resin, water, and an organic solvent, wherein the process for preparing the phase inversed resin emulsion excludes subjecting the phrase inversed resin emulsion to an organic solvent removal technique, thereby retaining the organic solvent in the phase inversed resin emulsion;

aggregating the particles to a predetermined size; and coalescing the particles of the predetermined size, wherein the mixture comprises at least three phase inversed resin emulsions, each phase inversed resin emulsion comprising a resin, water, and an organic solvent, wherein the phase inversed resin emulsion is one of the at least three phase inversed resin emulsions.

17. The process of claim 16, wherein a first phase inversed resin emulsion of the at least three phase inversed resin emulsions comprises a crystalline polyester resin, a second phase inversed resin emulsion of the at least three phase inversed resin emulsions comprises a first amorphous polyester resin, and a third phase inversed resin emulsion of the at least three phase inversed resin emulsions comprises a second amorphous polyester resin.

18. The process of claim 17, wherein the crystalline polyester resin is poly(1,6-hexylene-1,12-dodecanoate), the first amorphous polyester resin is poly(propoxylated-ethoxylated bisphenol-co-terephthalate-dodecenylsuccinate-trimellitic anhydride), and the second amorphous polyester resin is poly(propoxylated bisphenol-co-terephthlate-fumarate-dodecenylsuccinate).

* * * * *